US009302876B2

(12) United States Patent
Phillips et al.

(10) Patent No.: US 9,302,876 B2
(45) Date of Patent: Apr. 5, 2016

(54) MEDIA PRESENTER

(71) Applicant: NCR Corporation, Duluth, GA (US)

(72) Inventors: Joanna Phillips, Scotland (GB); Gordon Burke, Scotland (GB); Kenneth Peters, Scotland (GB); Joshua Bruce, Kitchener (CA)

(73) Assignee: NCR Corporation, Duluth, GA (US)

( * ) Notice: Subject to any disclaimer, the term of this patent is extended or adjusted under 35 U.S.C. 154(b) by 0 days.

(21) Appl. No.: 14/134,266

(22) Filed: Dec. 19, 2013

(65) Prior Publication Data

US 2015/0175370 A1 Jun. 25, 2015

(51) Int. Cl.

| | |
|---|---|
| ***B65H 31/34*** | (2006.01) |
| ***B65H 31/20*** | (2006.01) |
| ***B65H 31/36*** | (2006.01) |
| ***B65H 31/02*** | (2006.01) |

(52) U.S. Cl.

CPC ..... *B65H 31/20* (2013.01); *B65H 31/02* (2013.01); *B65H 31/34* (2013.01); *B65H 31/36* (2013.01); *B65H 2301/4212* (2013.01); *B65H 2301/4213* (2013.01); *B65H 2405/1124* (2013.01); *B65H 2511/11* (2013.01); *B65H 2511/20* (2013.01); *B65H 2551/29* (2013.01); *B65H 2701/1912* (2013.01)

(58) Field of Classification Search

CPC ..... B65H 31/34; B65H 31/36; B65H 31/20; B65H 31/02; B65H 31/3081; B65H 31/40; B65H 2511/11; B65H 2511/12

USPC ..... 271/223, 224, 187, 315

See application file for complete search history.

(56) References Cited

U.S. PATENT DOCUMENTS

| | | | | |
|---|---|---|---|---|
| 4,664,368 | A * | 5/1987 | Bouwens et al. | 271/209 |
| 5,188,353 | A * | 2/1993 | Parks | 271/184 |
| 5,342,165 | A * | 8/1994 | Graef et al. | 414/788.9 |
| 6,032,948 | A * | 3/2000 | Peebles et al. | 271/224 |
| 6,536,760 | B1 * | 3/2003 | Spina et al. | 271/207 |
| 7,464,930 | B2 * | 12/2008 | Masuda et al. | 271/224 |
| 8,366,107 | B2 * | 2/2013 | Deas et al. | 271/315 |
| 2011/0228358 | A1 * | 9/2011 | Ookawa | B65H 31/3081 358/498 |
| 2013/0285311 | A1 * | 10/2013 | Sugitani | 271/208 |

* cited by examiner

*Primary Examiner* — Luis A Gonzalez

(74) *Attorney, Agent, or Firm* — Schwegman, Lundberg & Woessner

(57) ABSTRACT

The present invention provides apparatus for stacking media items, comprising a base member for supporting a stack of media items, at least one first registration member extending generally upwardly with respect to the base member, and at least one further registration member extending generally upwardly with respect to the base member and spaced apart from the first registration member, wherein at least a one of the first and further registration members is selectively moveable towards or away from a remainder one of the first and further registration members in an input direction of the media items. A method of stacking media items is also provided.

10 Claims, 6 Drawing Sheets

FIG. 1
PRIOR ART
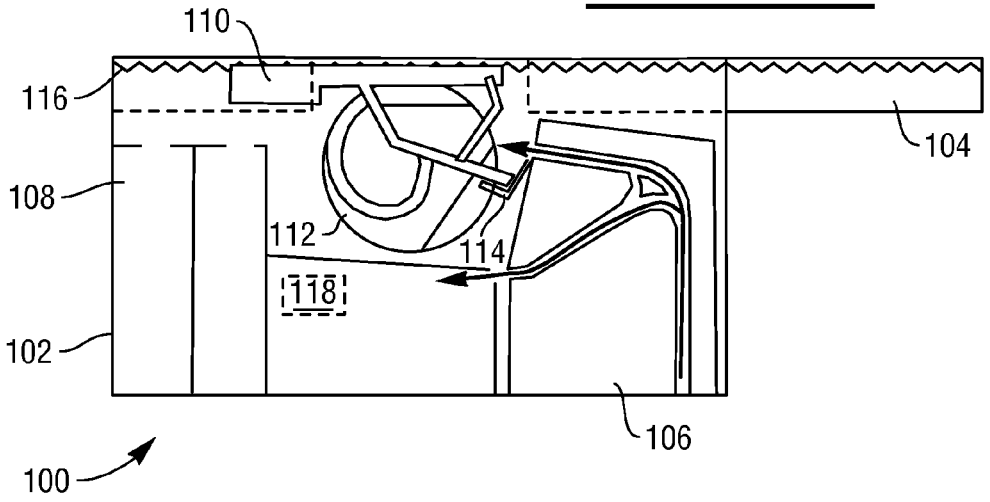
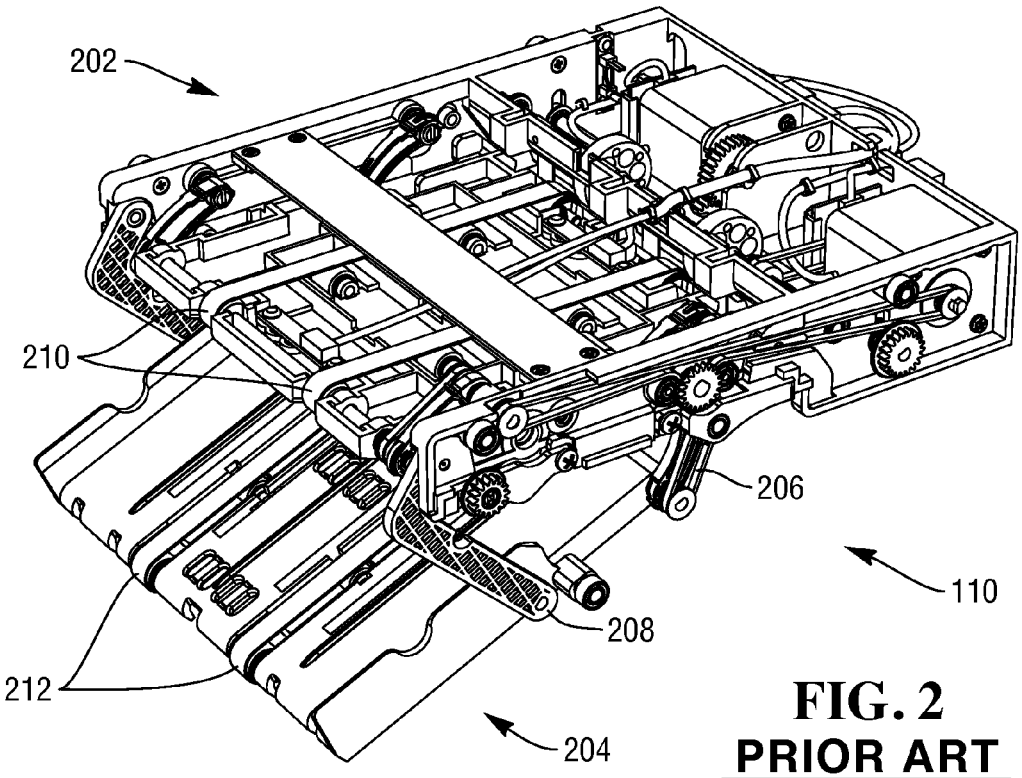
FIG. 2
PRIOR ART

MEDIA PRESENTER

FIELD OF THE INVENTION

The present invention relates to media item presenters and, in particular, but not exclusively, to stacking a number of media items into a bunch of media items.

A media item presenter is used as part of a media item dispenser. A media item presenter is that part of the dispenser that presents media items to a customer. One common type of media item dispenser is a bunch sheet media dispenser, such as an Automated Teller Machine (ATM), for dispensing a bunch (or stack) of media items in sheet form to a customer, such as banknotes, tickets, coupons, vouchers, giros, or the like.

A media item presenter is typically coupled to one or more media pick units of the dispenser. Each media pick unit picks individual media items from a media cassette (or a hopper) located inside the media dispenser, and transports the picked media items to the media item presenter for collating the media items into a bunch for presenting to a customer. If the customer does not remove the presented bunch of media items, the media item presenter withdraws the bunch and transports it to a purge bin for later processing by an authorized person.

A common type of media item presenter is a banknote presenter of an ATM. As shown in FIG. 1, a conventional banknote presenter 100 includes a chassis 102, a nose portion 104, a banknote transport unit 106 for coupling to a pick unit (not shown) of a dispenser, a multi-compartment purge bin 108, a carriage 110, a cam block 112, a registration device 114, a track 116 and a control board 118. The carriage 110 is selectively moveable along the track 116 between a loading position, where banknotes are loaded on to the carriage, and a presenting position, where banknotes are presented to a customer at the nose portion 104 of the presenter 100 which is aligned with a dispense slot of the dispenser (not shown).

As shown in FIG. 2, the carriage 110 includes a carriage body 202 and a carriage plate 204 pivotally coupled to the carriage body 202 by two pairs of link arms 206, 208. The carriage plate 204 is selectively moveable by the cam block 112 of the presenter 100 between an open position (as depicted in FIG. 2) for receiving banknotes from the pick unit of the dispenser and a closed position for clamping and transporting media items to the nose portion 104 for presenting to a customer. The carriage body and carriage plate each include a pair of spaced apart transport belts 210, 212 for gripping media items and for transporting media items along a predetermined transport path, such as towards a customer for presentation to the customer or along a return path and into the purge bin 108.

FIG. 3 illustrates a conventional registration device 114 which includes a support plate 302 pivotally mounted to the chassis 102 of the presenter 100 by a bracket 303. A base portion 304 is slideably mounted to the support plate 302 to move in a parallel direction to a media item transport path, as indicated by arrow T. The base portion 304 includes a plurality of spaced apart and upwardly extending registration edge members 306 and a plurality of spaced apart and upwardly extending flight limiting fingers 308. The base portion 304 also includes a plurality of spaced apart rib members 310 for supporting banknotes in a low friction manner allowing individual banknotes to slide towards the registration edge members 306 after contacting the flight limiting fingers 308.

As shown in FIG. 4, as the carriage plate 204 moves downwardly towards the carriage open position, the carriage plate 204 engages with the registration edge members 306 of the registration device 114 and forces the base portion 304 (and the integrally formed registration edge members 306 and flight limiting fingers 308) away from the carriage 110. At the same time, the flight limiting fingers 308 and ribs 310 of the base portion 304 extend through the carriage plate 204. In use, banknotes are sprayed over the registration edge members 306 and onto the carriage plate 204 (from left to right as viewed in FIG. 4). The flight of the banknotes is limited by the flight limiting fingers 308 and the force of gravity urges each banknote to rest on the base portion 304 of the registration device 114. As the base portion 304 of the registration device 114 is oriented in parallel with the oriented carriage plate 204, the banknotes slide away from the flight limiting fingers 308 and abut against the registration edge members 306 to form a bunch of stacked banknotes. After a desired bunch of banknotes has been stacked, the carriage plate 204 moves to a closed position to clamp the bunch of banknotes between the carriage plate 204 and the carriage body 202 for transportation along the track 116 of the presenter 100.

However, the distance between the flight limiting fingers 308 and the registration edge members 306 of the registration device 114 is fixed. Thus, the registration device 114 is not suitable for stacking different types and/or sizes of media item, such as different currencies of bank notes, particularly banknotes having a short edge length (or banknote height) which is less than the fixed distance between the fingers 308 and registration edge members 306. For example, the distance between the fingers 308 and registration edge members 306 of the conventional registration device 114 may be suitable for stacking Euro banknotes but when it is desirable to stack banknotes having a smaller height (short edge length) from a different country, the smaller bank notes are able to move between the fingers and the registration edge members as the stack is being created. This undesirably results in the stack becoming splayed and untidy which is not acceptable for presentation to a customer. In addition, badly splayed bunches of banknotes can cause jams and/or damage to the banknotes or ATM which undesirably places the ATM out of service. Furthermore, the space envelope available for the registration device of a media presenter is limited so it would be desirable to reduce the space envelope required by the registration device.

SUMMARY OF THE INVENTION

It is an aim of the present invention to at least partly mitigate the above-mentioned problems.

It is an aim of certain embodiments of the present invention to provide a method and apparatus for neatly and accurately stacking media items of different sizes.

It is an aim of certain embodiments of the present invention to provide a method and apparatus for stacking media items which is reliable and consistent, whilst reducing the risk of purge jams and consequently less downtime of the media item presenter.

It is an aim of certain embodiments of the present invention to reduce the space envelope within a media item presenter which is required by the registration device of the media item presenter.

It is an aim of certain embodiments of the present invention to provide a registration device for a media item presenter which is universal for stacking differently sized media items, such as banknotes from different countries.

According to a first aspect of the present invention there is provided apparatus for stacking media items, comprising:

a base member for supporting a stack of media items;

at least one first registration member extending generally upwardly with respect to the base member; and at least one further registration member extending generally upwardly with respect to the base member and spaced apart from the first registration member; wherein at least a one of the first and further registration members is selectively moveable towards or away from a remainder one of the first and further registration members in an input direction of the media items.

Aptly, the at least one of the first and further registration members is selectively translatable with respect to the remainder one of the first and further registration members.

Aptly, the at least one of the first and further registration members is selectively pivotable with respect to the remainder one of the first and further registration members.

Aptly, the apparatus further comprises a support member, wherein the base member is slideably coupled to the support member.

Aptly, the first registration member is integral with the base member.

Aptly, the further registration member is slideably coupled to the support plate to move towards or away from the first registration member.

Aptly, the further registration member is pivotally mounted to a rack member by a pivot shaft and said rack member is slideably mounted to said support plate.

Aptly, the further registration member is biased towards the first registration member by a first biasing element.

Aptly, the support member is pivotally mounted to a support bracket and biased towards a generally horizontal position by a further biasing element.

Aptly, the further registration member is selectively movable towards or away from the first registration member responsive to a position of the rack member relative to the first registration member.

Aptly, the further registration member is moveable between a retracted position and a deployed position responsive to the position of the rack member relative to the first registration member.

Aptly, a predetermined angle of the further registration member relative to the first registration member is substantially constant when the further registration member is in the deployed position.

Aptly, the predetermined angle is substantially zero such that the further registration member is substantially parallel with the first registration member when in the deployed position.

Aptly, the first registration member comprises a plurality of spaced apart first elongate members.

Aptly, the further registration member comprises a plurality of spaced apart further elongate members.

Aptly, the base member comprises a plurality of spaced apart fins upstanding from the base member to support a stack of media items.

Aptly, the base member comprises a pair of spaced apart guide members in faced relationship, each guide member upwardly extending from a respective side region of the base member.

According to a second aspect of the present invention there is provided a media item presenter comprising apparatus according to the first aspect of the present invention.

According to a third aspect of the present invention there is provided a Self-Service Terminal (SST) comprising a media item presenter in according to the second aspect of the present invention.

According to a fourth aspect of the present invention there is provided a method of stacking media items, comprising:

selectively moving at least a one of a first registration member and a further registration member towards or away from a remainder one of the first and further registration members; and individually dispensing a plurality of media items on to a base member located between the first and further registration members, wherein each registration member extends generally upwardly with respect to the base member and the media items are dispensed in a direction from the first registration member to the further registration member.

Aptly, the method further comprises:

selectively translating the further registration member towards or away from the first registration member.

Aptly, the method further comprises:

selectively pivoting the further registration member towards or away from the first registration member.

Aptly, the method further comprises:

selectively moving the further registration member with respect to the first registration member responsive to a predetermined common dimension of the media items.

Aptly, the method further comprises:

selectively moving the further registration member with respect to the first registration member responsive to a position of a moveable rack member to which the further registration member is pivotally mounted.

Aptly, the method further comprises:

selectively moving a first registration member with respect to a further registration member responsive to a predetermined common dimension of a plurality of media items to be stacked; and individually dispensing the plurality of media items towards the first registration member to be stacked between the first and further registration members.

According to a fifth aspect of the present invention there is provided a generally U-shaped media item stacking apparatus comprising:

a base portion for supporting a stack of media items;

a first registration member generally upstanding with respect to a first edge region of said base portion; and a further registration member generally upstanding with respect to a further edge region of said base portion; wherein at least a one of the first and further registration members is selectively moveable with respect to a remainder one of the first and further registration members in an input direction of the media items.

Certain embodiments of the present invention may provide the advantage of controlling the flight distance and rebound of media items being stacked.

Certain embodiments of the present invention may provide the advantage of neatly and accurately stacking media items of different sizes.

Certain embodiments of the present invention may provide the advantage of reducing the risk of jamming and in turn downtime of a media item presenter.

Certain embodiments of the present invention may provide the advantage of reducing the space envelope required by a registration device within a media item presenter.

BRIEF DESCRIPTION OF DRAWINGS

Embodiments of the present invention will now be described hereinafter, by way of example only, with reference to the accompanying drawings in which:

FIG. 1 illustrates a simplified schematic diagram of a conventional rear access media item presenter;

FIG. 2 illustrates a perspective view of a conventional carriage of the media presenter of FIG. 1 when the carriage is in an open position;

DESCRIPTION OF EMBODIMENTS

Figure 3:
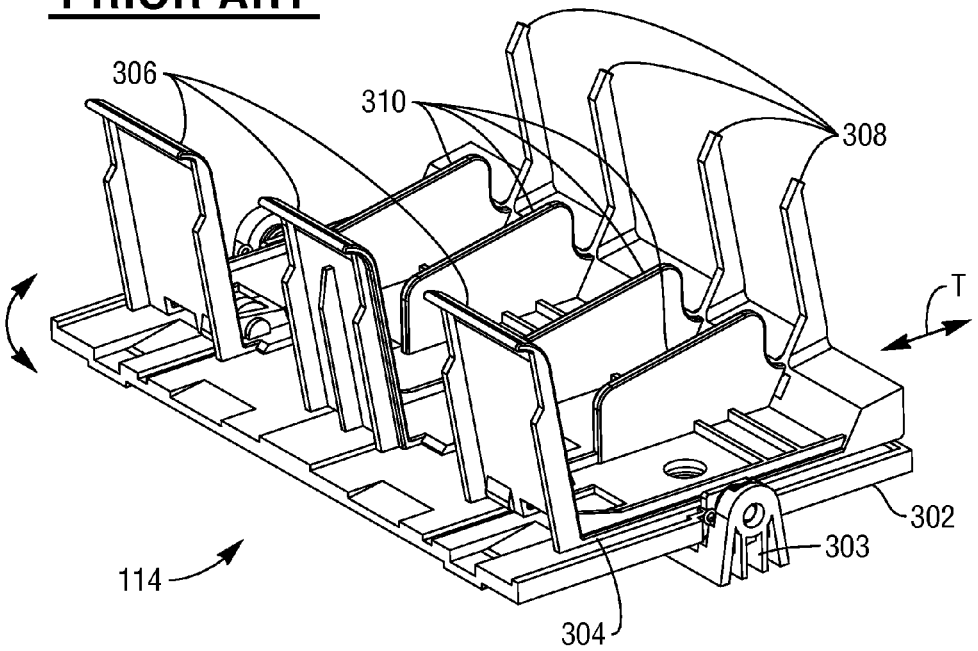
FIG. 3 PRIOR ART
FIG. 3 illustrates a side view of a conventional registration device for stacking media items on the carriage of FIG. 2.
Figure 4:
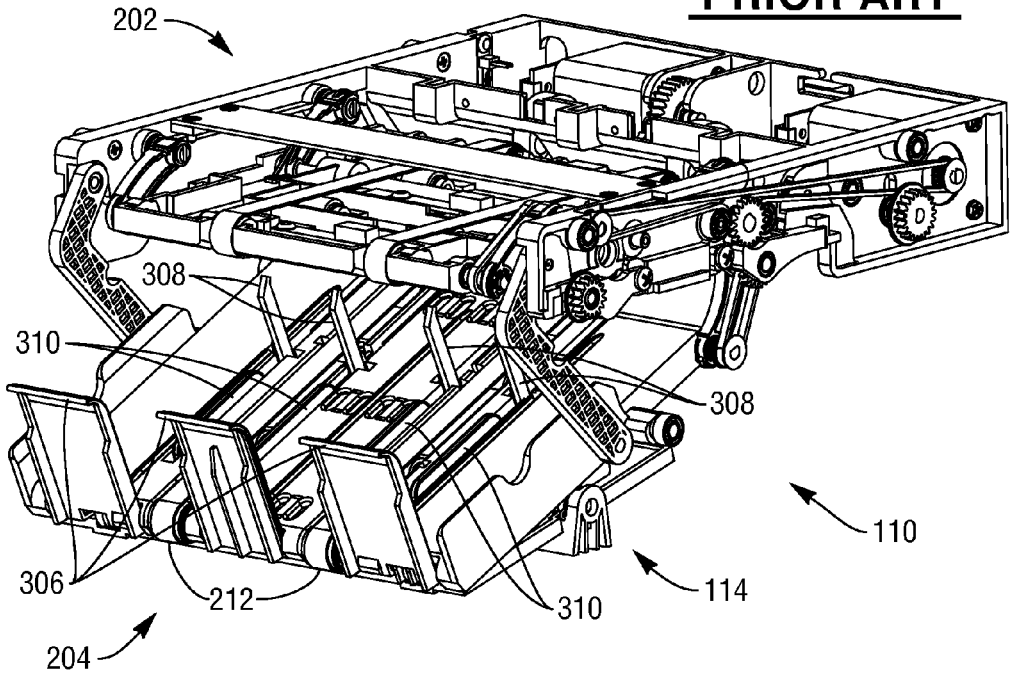
FIG. 4 PRIOR ART
FIG. 4 illustrates the carriage in the open position and engaged with the registration device of FIG. 3.

In the drawings like reference numerals refer to like parts.

Figure 5A:
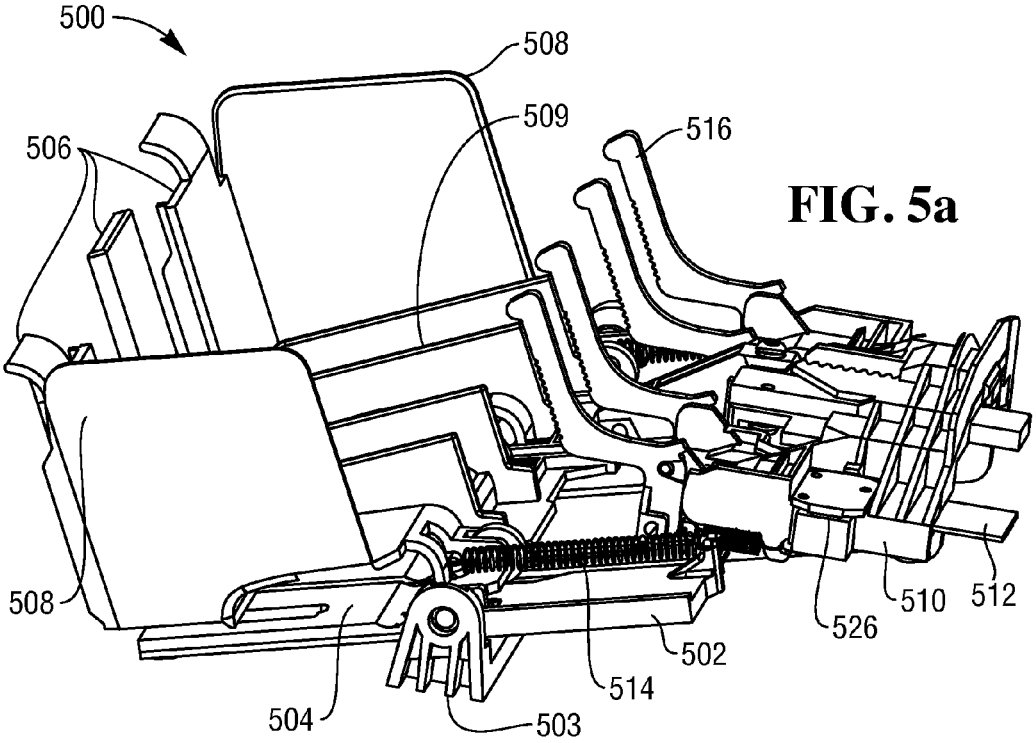
FIG. 5*a* illustrates a registration device according to an embodiment of the present invention with the flight limiting fingers in a first position.
Figure 5B:
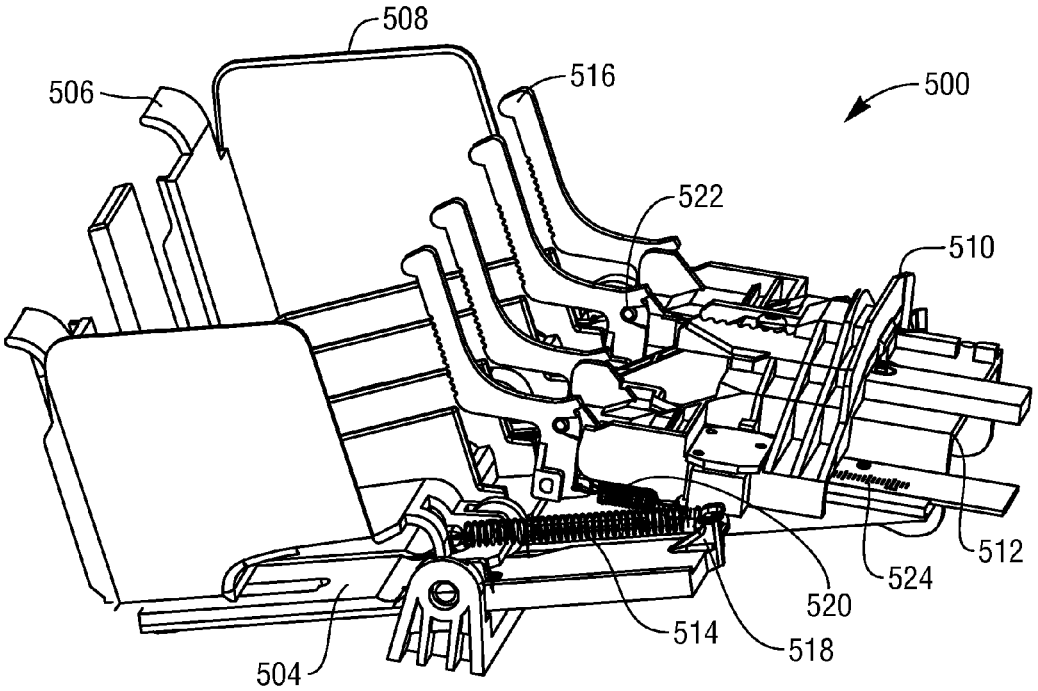
FIG. 5*b* illustrates the registration device of FIG. 5*a* with the flight limiting fingers in a second position.

FIGS. 5*a* and 5*b* illustrate a registration device 500 according to certain embodiments of the present invention. The registration device 500 includes a support plate 502 pivotally mounted to a bracket 503 fixed to the chassis (not shown) of the media item presenter. The support plate 502 is biased by a spring (not shown) substantially towards the horizontal plane. The support plate 502 includes a plurality of spaced apart channels to slideably support a base portion 504 having corresponding projections (not shown) on an underside thereof. A plurality of spaced apart registration edge members 506 are integrally formed with, and upwardly extend from, the base portion 504. The base member 504 further includes a pair of spaced apart side members 508 which are substantially sheet-like and arranged in parallel with a transport path along which banknotes are sprayed onto the base portion 504 by a pick unit (not shown) of the presenter. The base member 504 also includes a plurality of spaced apart fins 509 upwardly extending from the base portion 504 to provide a low friction supporting surface for the banknotes. The fins 509 are sloped towards the registration edge members 506 to urge a lower long edge of each banknote towards the registration edge members 506. At an opposite edge region of the support plate 502 to the registration edge members 506, a pair of spaced apart posts 518 upwardly extend from corner regions of the support plate 502. A spring 514 extends between each post 518 and a respective corner region of the base member 504 to bias the base member 504 and the registration edge member 506 towards the pivot axis of the bracket 503.

The registration device 500 further includes a rack member 510 that is slidably mounted to a rail 512 attached to the support plate 502. A plurality of spaced apart elongate fingers 516 are mounted to the rack member 510. A motor (not shown) mounted on the rack member 510 drives a gear engaged with a toothed rack of the rail 512 to selectively move the rack member 510 and the elongate fingers 516 towards or away from the registration edge members 506. This allows the spacing between the registration edge members 506 and the elongate fingers 516 to be selectively changed responsive to a dimension of each banknote to be stacked. For example, for relatively tall banknotes, the elongate fingers 516 are moved away from the registration edge members 506 (as shown in FIG. 5*a*) to accommodate the relatively tall banknotes to be neatly stacked. In contrast, where relatively short banknotes are to be stacked, the plurality of elongate fingers 516 are moved towards the registration edge members 506 (as shown in FIG. 5*b*) responsive to the corresponding height of the relatively short banknotes to be stacked. In this way, the registration device 500 can be adjusted to efficiently and consistently create an aligned and tidy stack of banknotes for presenting to a customer irrespective of the height of banknotes to be stacked. The spacing between the elongate fingers 516 and registration edge members 506 can be adjusted from around 70 mm to around 90 mm. A scale 524 may be provided for setting a desired spacing between the registration edge members 506 and the elongate fingers 516. A sensor 526 may determine the location of the elongate fingers 516 with respect to the registration edge members 506 and provide a feedback signal to the motor to automatically adjust the spacing between the registration members 506 and elongate fingers 516 accordingly.

Whilst the registration edge members 506 and elongate fingers 516 limit movement of each banknote in a direction parallel to the transport path of the banknotes, the sheet-like side members 508 of the registration device limit movement of the banknotes being stacked in a direction perpendicular to the transport path of the banknotes. In a similar manner to the elongate fingers 516, one or both of the side members 508 may be moveable with respect to the other side member to adjust the spacing between the side members 508 to accommodate for relatively thin or wide banknotes.

Figure 7:
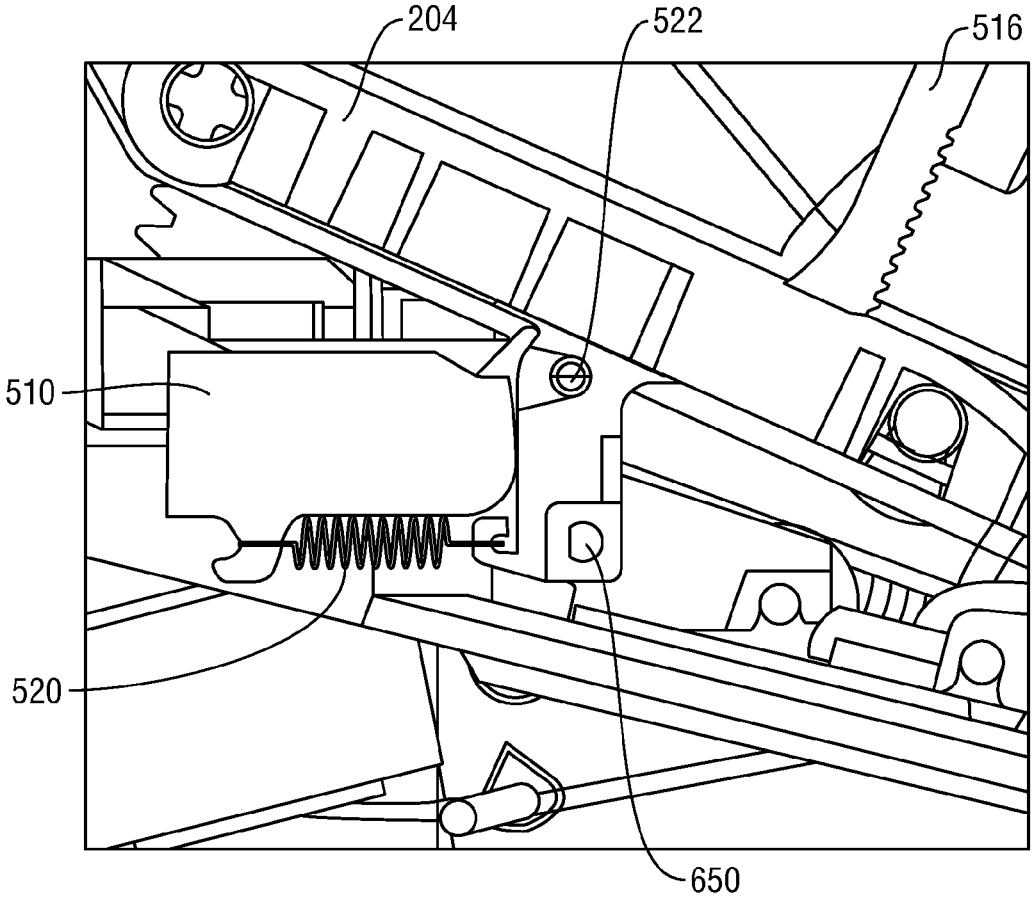
FIG. 7 illustrates a side view of the pivoting mechanism for rotating the flight limiting fingers in response to movement of the carriage plate.

Furthermore, each elongate finger 516 is pivotally mounted to the rack member 510 by at least one shaft 522 and is rotatable relative to the rack member 510. The elongate fingers 516 are biased towards the registration edge members 506 by at least one spring 520 (as shown in FIGS. 5*b* and 7). A further shaft 650 also connects each elongate finger 516 and at least one end of the shaft 650 follows a profiled member 652 such that the orientation of the elongate fingers 516 relative to the registration edge members 506 is automatically adjusted as the rack member is moved towards the registration edge members 506, as described further below. Alternatively, a motor may selectively rotate the shaft 522 and elongate fingers 516 and a further sensor may be provided to determine a position of the elongate fingers 516 with respect to the registration edge members 506 and provide a corresponding feedback signal to the motor to automatically adjust the position of the elongate fingers 516 with respect to the registration edge members 506.

Figure 6A:
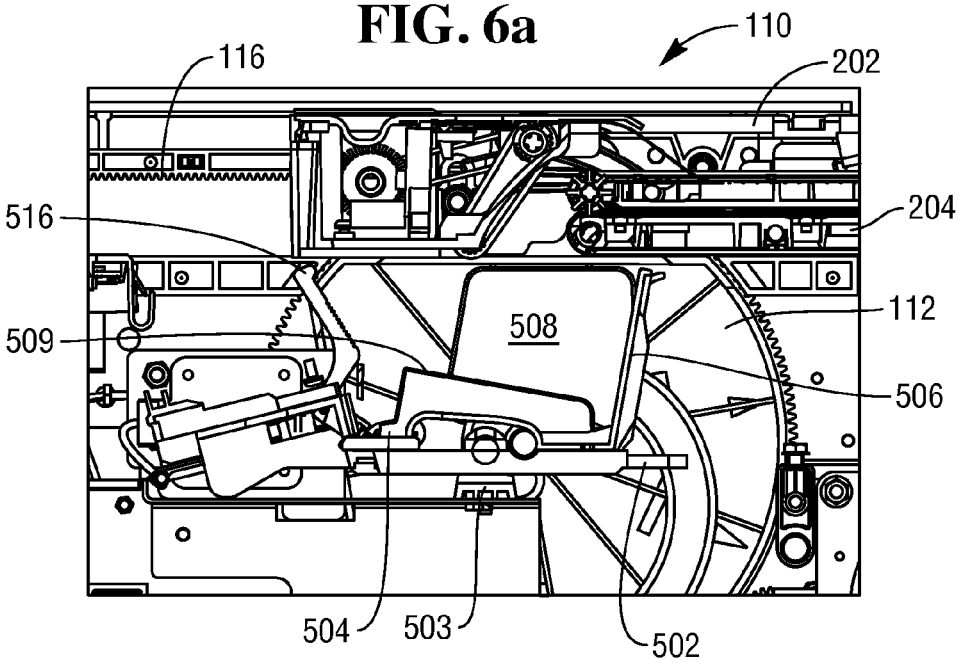
FIG. 6*a* illustrates a side view of part of a media presenter according to certain embodiments of the present invention wherein the flight limiting fingers of the registration device of FIGS. 5*a* and 5*b* are in a pivotally extended position relative to the registration edge members to allow sufficient clearance for the carriage to move along the track overhead.

In use, as shown in FIG. 6*a*, the elongate fingers 516 are retracted back to allow the carriage 110 to pass overhead along its track 116 and for the carriage plate 204 to move downwardly towards the open position without clashing with the elongate fingers 516. This allows the required space envelope for the carriage 110 and/or the registration device 500 to be reduced and in turn provides for a more compact banknote note presenter 100.

Figure 6B:
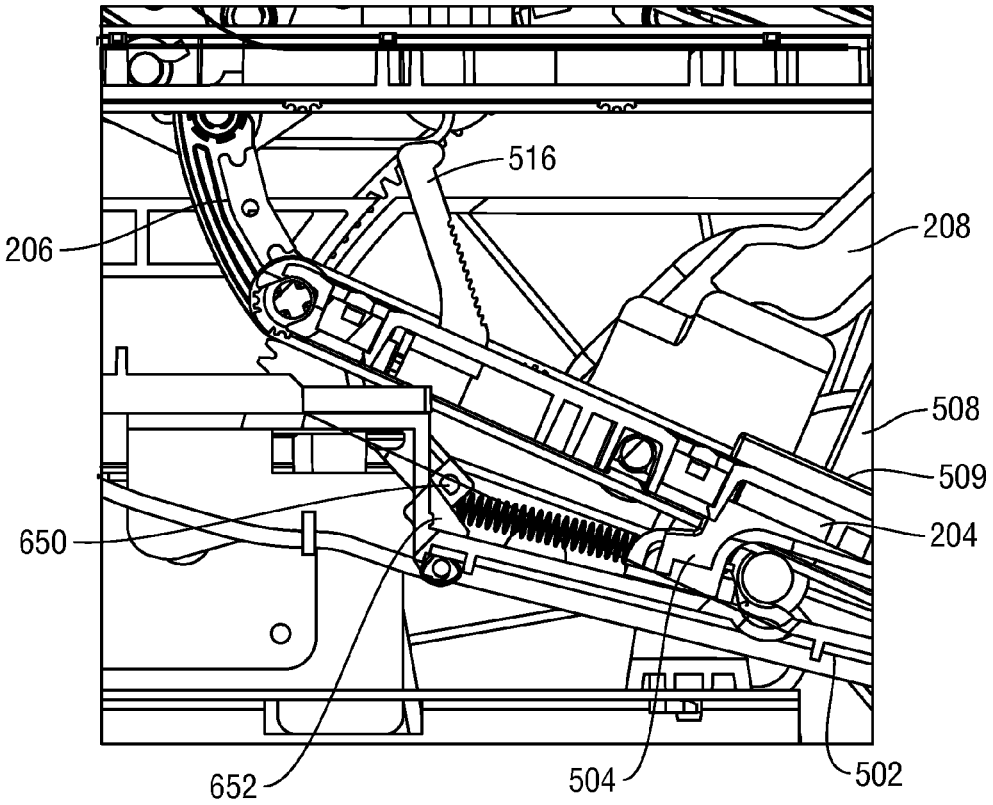
FIG. 6*b* illustrates the carriage plate of the carriage in an open position and the flight limiting fingers rotating towards the registration edge members as the carriage plate moves downwardly.

As shown in FIG. 6*b*, when the carriage plate 204 is moved downwardly towards the open position, the elongate fingers 516 extend through the carriage plate 204 and the carriage plate 204 engages the base member 504 of the registration device 500. The support plate 502 and base member 504 are forced downwardly by the carriage plate 204 about the pivot axis of the bracket 503 such that the registration edge members 506 are lower than the elongate fingers 516. As the carriage plate 204 continues to move downwardly to the open position, the registration edge members 506 (and the base member 504) are pushed away from the retracted elongate fingers 516 by the carriage plate 204 and against the spring force of the springs 514.

Figure 6C:
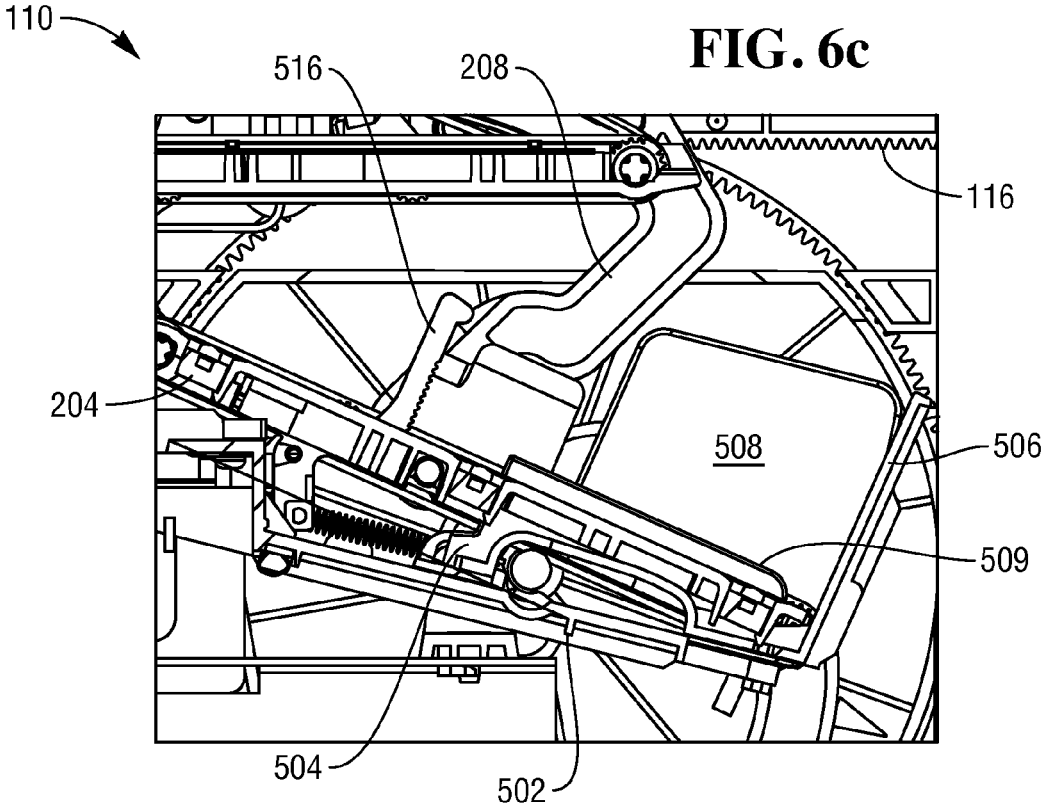
FIG. 6*c* illustrates the flight limiting fingers in the first position and in a substantially parallel spatial relationship with the registration edge members.
Figure 6D:
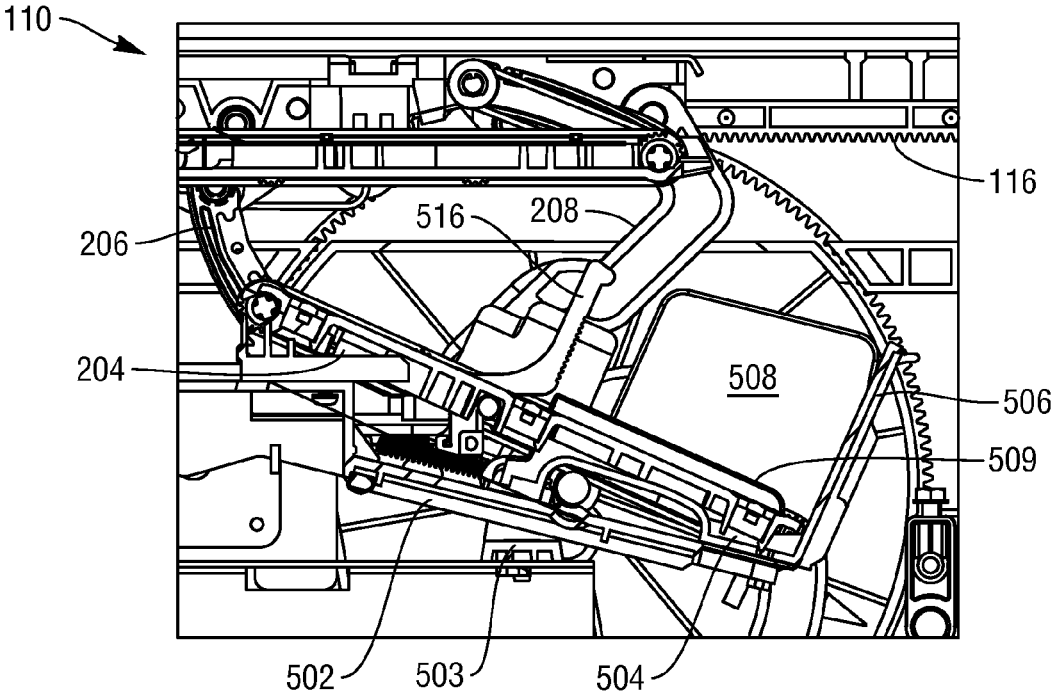
FIG. 6*d* illustrates the flight limiting fingers in the second position and in a substantially parallel spatial relationship with the registration edge members.

A motor (not shown) then drives the rack member 510 forward towards the registration edge members 506 and the shaft 650 follows the profile member 652 with the aid of spring 520 until the elongate fingers 516 are parallel to the registration edge members 506 and in a forward deployed position (as shown in FIG. 6*c*). As shown in FIG. 6*d*, the rack member 510 is then driven further towards the registration edge members 506 into a predetermined position dependent on the height (short edge) of the banknotes to be stacked by increments of a stepper motor (not shown) and a further sensor (not shown) checks the position of the elongate fingers 516 relative to the registration edge members 506 and adjusts the position of the rack member 510 accordingly, if required.

Individual banknotes are then sprayed onto the carriage plate 204 from right to left as viewed in FIG. 6*d*. The elongate fingers 516 limit the flight of the banknotes and urge the banknotes onto the fins 509 of the base member 504. The force of gravity urges each individual banknote downwardly towards the registration edge members 506 such that a lower long edge of each banknote abuts the registration edge members 506. The selective spacing of the elongate fingers 516 with respect to the registration edge members 506 ensures a bunch of banknotes having a common height dimension are neatly and consistently stacked without splaying or damage to the banknotes. The side members 508 also help to guide and align the banknotes in a lengthwise direction which is perpendicular to an input direction of the banknotes onto the carriage plate 204.

Throughout the description and claims of this specification, the words "comprise" and "contain" and variations of them mean "including but not limited to" and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of the features and/or steps are mutually exclusive. The invention is not restricted to any details of any foregoing embodiments. The invention extends to any novel one, or novel combination, of the features disclosed in this specification (including any accompanying claims, abstract and drawings), or to any novel one, or any novel combination, of the steps of any method or process so disclosed.

The reader's attention is directed to all papers and documents which are filed concurrently with or previous to this specification in connection with this application and which are open to public inspection with this specification, and the contents of all such papers and documents are incorporated herein by reference.

What is claimed is:

1. Apparatus for stacking media items, comprising:

a base member for supporting a stack of media items;

a support member, wherein the base member is slideably coupled to the support member;

at least one first registration member integrally formed with the base member and extending generally upwardly with respect to the base member; and at least one further registration member extending generally upwardly with respect to the base member and spaced apart from the first registration member;

wherein the further registration member is selectively moveable towards or away from the first registration member in an input direction of the media items, wherein the further registration member is selectively pivotable with respect to the first registration member member.

2. Apparatus as claimed in claim 1, wherein the further registration member is selectively translatable with respect to the first registration member.

3. Apparatus as claimed in claim 1, wherein the further registration member is slideably coupled to the support member to move towards or away from the first registration member.

4. A media item presenter comprising apparatus as claimed in claim 1.

5. Apparatus for stacking media items, comprising:

a base member for supporting a stack of media items;

a support member, wherein the base member is slideably coupled to the support member;

at least one first registration member integrally formed with the base member and extending generally upwardly with respect to the base member; and at least one further registration member extending generally upwardly with respect to the base member and spaced apart from the first registration member;

wherein the further registration member is selectively moveable towards or away from the first registration member in an input direction of the media items wherein the further registration member is pivotally mounted to a rack member by a pivot shaft and said rack member is slideably mounted to said support member.

6. Apparatus as claimed in claim 5, wherein the further registration member is selectively movable towards or away from the first registration member responsive to a position of the rack member relative to the first registration member.

7. A method of stacking media items, comprising:

selectively moving at least a one of a first registration member and a further registration member towards or away from a remainder one of the first and further registration members;

selectively moving the further registration member with respect to the first registration member responsive to a position of a moveable rack member to which the further registration member is pivotally mounted; and individually dispensing a plurality of media items on to a base member located between the first and further registration members, wherein each registration member extends generally upwardly with respect to the base member and the media items are dispensed in a direction from the first registration member to the further registration member.

8. The method as claimed in claim 7, further comprising: selectively translating the further registration member towards or away from the first registration member.

9. The method as claimed in claim 7, further comprising: selectively pivoting the further registration member towards or away from the first registration member.

10. The method as claimed in claim 7, further comprising: selectively moving the further registration member with respect to the first registration member responsive to a predetermined common dimension of the media items.

* * * * *